United States Patent [19]

Rzechula

[11] Patent Number: 4,953,360

[45] Date of Patent: Sep. 4, 1990

[54] ADDITIVE FOR TREATING WATER USED TO FORM ICE

[75] Inventor: Michael J. Rzechula, Elizabethtown, Ill.

[73] Assignee: Slick Ice Limited, Elizabethtown, Ill.

[21] Appl. No.: 411,117

[22] Filed: Sep. 27, 1989

[51] Int. Cl.[5] ..... E01H 4/02

[52] U.S. Cl. ..... 62/66; 62/235; 106/13; 252/70

[58] Field of Search ..... 252/70; 106/13; 62/235, 62/1, 66

[56] References Cited

U.S. PATENT DOCUMENTS

| | | | |
|---|---|---|---|
| 3,489,596 | 1/1970 | Plump | 106/13 X |
| 3,736,172 | 5/1973 | Delano et al. | 106/13 X |
| 4,213,873 | 7/1980 | Church | 106/13 X |
| 4,676,918 | 6/1987 | Toth et al. | 106/13 X |
| 4,728,536 | 3/1988 | Barley et al. | 62/235 X |
| 4,774,112 | 9/1988 | Achtenberg et al. | 106/13 X |

FOREIGN PATENT DOCUMENTS

| | | | |
|---|---|---|---|
| 686392 | 5/1970 | Canada | 252/70 |

*Primary Examiner*—William E. Tapolcai

*Attorney, Agent, or Firm*—Wood, Phillips, Mason, Recktenwald & VanSanten

[57] ABSTRACT

The high energy cost accompanying the use of hot water in resurfacing ice rinks is reduced by use of an additive for treating water used to form ice or ice layers which comprises a surfactant, a primary alcohol and a silicone. The surfactant acts to reduce permanently the surface tension of the water while the silicone acts as a defoamer collapsing any bubbles formed on the surface and also as a lubricant when pressure is applied on the ice such as by an ice skate blade. The alcohol is believed to aid in providing a generally homogenous mixture when added to water. The composition allows the use of much cooler water, normally in the range of 45° to 55° F., in forming ice with favorable characteristics. The invention also encompasses novel methods of forming layers of ice using the additive.

28 Claims, No Drawings

ADDITIVE FOR TREATING WATER USED TO FORM ICE

DESCRIPTION

1. Field of the Invention

This invention relates to a water additive used to form a layer of ice and methods of forming a layer of ice.

2. Backqround of the Invention

In this country within the past 15 years, a great emphasis has been placed on energy conservation. This emphasis has been spurred on mainly by increasing energy prices. Ice rinks in particular have been hard hit by increasing energy costs. Ice rinks use tremendous quantities of energy to freeze and maintain ice normally 24 hours a days, seven days a week for the vast majority or even the entirety of a year.

As energy prices have increased, more and more ways to reduce costs of maintaining the ice have been explored. Many rinks have added insulation and have reduced room temperature. Other rinks have undertaken expensive capital improvement projects, such as installation of heat recycling systems. Still others have placed thermal blankets over the ice at night to conserve energy.

One area of maintenance of ice rinks that is particularly energy inefficient is the resurfacing of the ice rink. Due to the action of skating, the ice surface becomes chipped and shavings build up, both of which reduce the quality of the ice. To combat this reduction in quality, the rink periodically requires resurfacing. Resurfacing is normally carried out by the use of machines, such as a Zamboni® machine, which first shaves the ice with a large blade mounted on the machine and then adds a layer of water onto the just shaved surface to form the new layer of ice.

The traditional method of resurfacing uses hot water because it provides a superior ice surface with a minimum application of fresh water. The superiority of hot water is the result of its lower surface tension which enables it to be spread into a thin film which fills small cracks and fissures and creates a stable bond between the old surface and the resurfacing water.

In the traditional resurfacing process, water has to be heated to a minimum of 150°. Thereafter, enough hot water is applied to the surface to melt the ice, assuring an effective bond. The newly applied hot water has to then be cooled down to an operating temperature near 25° F. Of course, during the time that it takes to cool the newly applied hot water, skating is not permitted. Obviously, the traditional resurfacing procedure uses vast amounts of energy to heat and then cool the water used for resurfacing.

Attempts at using untreated cool water in the procedure instead of the "heat-cool" cycle with hot water have met with two substantial problems. The first is that the cool water does not provide a very effective bond. The reason for the ineffective bond formation is that the cool water has a high surface tension and does not spread out and make contact as well as the hot water. Further, because of the higher surface tension, the cool water fails to spread as freely and as effectively to fill small cracks and fissures as does the hot water.

The second problem arises when trying to alleviate the first problem in using cool water. The only way to assure an effective bond using cool water is to apply a very heavy layer of water. This is detrimental because it causes rapid ice buildup which creates an increased load on compressors, thereby greatly increasing the energy used to retain the ice surface.

SUMMARY OF THE INVENTION

It is an object of the invention to overcome one or more of the problems described above.

According to the present invention, a water additive for use in forming ice layers with desirable characteristics comprising a surfactant, a primary alcohol, and silicone is provided. The surfactant acts to reduce the surface tension of the water when in aqueous solution. The lower surface tension allows the water to spread out and bond more effectively. The silicone acts as a lubricant in the aqueous solution and is liberated from the ice surface when pressure is applied, such as in skating. The silicone also acts as a defoamer collapsing any bubbles formed on the surface by causing external stress on the bubbles. The alcohol is believed to aid in dispersion so as to provide a generally homogenous mixture in water.

When added to water, the additive allows for the use of cool water for resurfacing as the surface tension is greatly reduced. The lubricating effect of the silicone will produce superior ice characteristics, especially when used, for example, as in skating, as it provides a more fluid movement across the ice.

In addition to the water additive composition, the invention comprehends novel methods of forming ice layers.

Other objects and advantages of the invention will be apparent to those skilled in the art in the following detailed description taken in conjunction with the appended claims.

DETAILS AND DESCRIPTION OF THE INVENTION

According to the invention, a water additive comprising a surfactant, a primary alcohol, and silicone is provided. More preferred primary alcohols include ethyl, methyl and isopropyl alcohols. The additive, when used to form ice layers, results in energy-related and physical characteristic benefits In the preferred embodiment, the additive is comprised of a tridecyl alcohol surfactant, a silicone oil emulsion, and ethyl alcohol which is believed to act as a solvent or dispersant, so as to provide a generally homogenous mixture. The preferred volumetric percentages of the components are about 36–63% of the surfactant, about 7.4–21.3% of the silicone, 7.6–24.0% of the alcohol, and about 15.0–34.09% of the water. In a particularly preferred embodiment, the composition is made up volumetrically of about 43.9–55% of the surfactant, about 9.7–16.6% of the silicone, about 10.0–18.9% of the alcohol and about 19.5–27.8% of the water.

Water is not a necessary component in the additive as the surfactant, alcohol, and silicone may be in concentrate form. However, the water aids in handling the additive. In such an embodiment of the invention, the additive has in parts by volume, about 4.5–6.8 parts of the surfactant, about 1.0–2.4 parts of the alcohol, and about 1.0–2.0 parts of the silcone.

The surfactant acts to reduce the surface tension of the water to less than that of the hot water traditionally used to resurface. This lowered surface tension allows the water to spread more freely and produce a more effective bond. While alcohol-based surfactants are preferable, any surfactant which can substantially lower the surface tension of the water will be adequate.

The ethyl alcohol is believed to assist in suspending the surfactant in the water. Other primary alcohols, such as isopropyl and methyl, can also be used effectively.

The silicone oil emulsion is both a defoamer and a lubricant. When forming the ice layer, the silicone oil emulsion collapses any bubbles formed by placing stress on the bubble. When pressure is applied to the formed ice layer, the silicone in the emulsion is liberated from the ice surface and acts as a lubricant. The silicone oil emulsion, preferably, should contain particulates having sizes in the range of 15 to 25 microns. The silicone need not be in emulsion, and may be in the form of fluid or powder, for example.

As far as energy-related benefits are concerned, the use of the additive assures that no hot water or the heating of water is necessary, as in the traditional resurfacing method. Under normal conditions, the temperature of the water mixed with the additive can be that directly out of a tap, which is normally about 50° F. Therefore, the heat-cool cycle and its accompanying large use of energy are avoided.

Another energy advantage of using the additive is that since the mixture is applied at a cooler temperature than the traditional process, the compressors of the refrigeration system do not need to work as hard to bring down the temperature of the newly applied layer. This saves hours of running time of the equipment. Also, since the temperature of the mixture is closer to that of the surface, there is a smoother, more consistent operation of the refrigeration equipment without the large variance in surface temperature. This results in less energy to run the refrigeration equipment and also less wear and tear on the equipment. Obviously, it takes less time to freeze the resurfacing layer so that activities on the ice may resume more quickly providing for increased rink utilization at reduced cost.

Advantageous physical characteristics are also produced by using the additive. A satin finish is produced which refracts the visible light and ultraviolet heat radiation at the ice surface rather than allowing it to pass through the ice surface and be reflected back through the ice and out. This satin finish is believed to be produced by the emulsion particulates. By reducing the absorption into the ice, the ice layer is maintained longer and more efficiently. Also, the satin finish eliminates the nuisance of glare from lights or the sun at outdoor rinks.

The frozen mixture formed with the additive does not as readily sublimate as plain water ice. At outdoor rinks, this inhibits wind erosion of the ice surface. This results in the reduction or near elimination of fog vapor for indoor rinks in warmer climates or during summer operation and in a longer lasting ice surface.

The additive and water mixture also freezes in smaller and more uniform ice crystals than just water, which lessens the deterioration of the ice surface due to skating. When a skate blade cuts through untreated ice, crystals at angles to the blades are chiseled out of the ice. Because the crystals on conventionally formed ice are of larger and varying size, large chunks of ice are chiseled up. With the frozen additive/water mixture, the skate blade still chisels up ice crystals but, because they are smaller and more uniform, the deterioration is not as pronounced nor does it occur as quickly. With less deterioration, snow buildup on the ice surface is reduced. Less snow results in less effort in cleaning the rink and less down time for resurfacing.

Having a lower surface tension also allows the mixture to flow more readily. The mixture, therefore, fills in pits and fissures effectively to form good bond with the ice surface.

The mixture also provides a faster skating surface. Skating is possible in that, when the blade contacts the ice, the thin layer of ice is transformed into water temporarily and this water becomes a lubricant between the ice surface and the blade. With hot water, once it cools, it has a high surface tension. However, when using the additive, the surface tension is permanently altered so even upon freezing, the mixture still has a low surface tension and as such, it takes less pressure to form the water lubricant film. As previously mentioned, the silicone also acts as a lubricant and, therefore, enhances this skating effect.

When used in resurfacing, the resurfacing blade cuts or shaves the ice more effectively, resulting in a better ice surface. The mixture acts in the same way as a good shaving cream affects the performance of a safety razor blade. The blade, therefore, is subjected to lesser wear and tear than if associated with the use of hot water resurfacing.

The invention also comprehends novel methods of forming layers of ice and especially on ice skating rinks.

The resurfacing of an ice rink is carried on by a resurfacing unit, such as but not limited to a Zamboni ®. The Zamboni ® has a water tank which holds the water to form the new layer of ice, and a blade to shave the old top layer of ice.

The first step is to provide the well-mixed additive in the ratios previously described. A preferred solution for resurfacing, once the additive has been mixed with the water to be treated, is, in volumetric percentages, about 50.0 to 77.0% of an alcohol-based surfactant, about 9.9 to 27.0% of a silicone oil emulsion, and about 10.0 to 30.0% of ethyl alcohol, and no more than 1370 parts of water. An example of the makeup of the additive would be 13–20 ounces of the surfactant, 3–6 ounces of the silicone, 3–7 ounces of ethyl alcohol, and 5.75–9.75 ounces of water. The amount of additive used in the tank of the resurfacing machine, which normally holds approximately 200 gallons, should normally be at least approximately 32 ounces of the proportionately mixed additive, or 0.16 ounces per gallon.

It may be advantageous before adding the additive directly into the resurfacing machine's tank to premix the additive in a gallon container with water and mixing that solution well before adding to the tank.

The next step is to add water to the resurfacing unit tank until approximately 10 gallons have been added. This water will prevent unmixed additive from settling in the pipes of the resurfacing unit.

The additive is then poured into the tank and the tank is filled with an adequate amount of water to resurface the rink.

The temperature of the water used for resurfacing may be that of tap water, which is around about 45° to 55° F., although use of water at other temperatures is possible. However, if the rink's ice temperature is below 19° F. or the air temperature extremely low (below approximately 20°), the water temperature should be warmer and the water temperature range found to be effective in these conditions would be between 65° and 85° F. The use of the warmer water will delay freezing of the mixture and allow a stronger and more complete bond between the mixture and the ice surface to form by allowing the film of treated water time to level out. Quick freezing under such conditions may result in a less than optimal ice surface.

In the first application of the treated resurfacing water, or priming, a heavier application of treated water should be applied. In resurfacing ice that has previously been treated with the mixture, the ice should be shaved deep enough to remove the glazed surface to prevent ice buildup and a thinner film of the water is used.

Although the main use of the invention would be to form ice layers on ice skating rinks, the invention may be used to produce an ice layer on virtually any surface with a temperature less than the freezing point of the mixture.

The foregoing detailed description is given for clearness of understanding only and no unnecessary limitations are to be understood therefrom as modifications within the scope of the invention will be obvious to those skilled in the art.

What is claimed:

1. An additive to treat water used to form ice, comprising:

a surfactant, a primary alcohol selected from the group consisting of methyl, ethyl, or isopropyl, and a silicone.

2. The additive as recited in claim 1 comprising, in parts by volume, about 4.5–6.8 parts of said surfactant, about 1.0–2.4 parts of said alcohol, and about 1.0–2.0 parts of said silicone.

3. The additive as recited in claim 1 wherein the silicone is in the form of a silicone oil emulsion having silicone size of 15 to 25 microns.

4. The additive as recited in claim 1 wherein the surfactant is an alcohol-based surfactant.

5. A process for forming ice with an additive and water on a cooled surface having a temperature below the freezing point of the liquid mixture comprising the steps of: p1 (a) providing the additive of claim 1;

(b) mixing the additive with water; and (c) applying at least a portion of the mixture to the cooled surface.

6. The process as recited in claim 5 wherein the step of providing is performed by using a tridecyl alcohol surfactant.

7. The process as recited in claim 5 wherein the step of providing is performed using a silicone oil emulsion.

8. The process as recited in claim 7 wherein the silicone oil emulsion has a silicone size of 15 to 25 microns.

9. The process as recited in claim 5 wherein the step of mixing is performed using water having a temperature in the range of about 45° to 55° F.

10. The process as recited in claim 5 wherein the cooled surface is ice.

11. An aqueous solution for treating water for use in forming ice, comprising:

an alcohol-based surfactant, ethyl alcohol, a silicone and water.

12. The composition as recited in claim 11 wherein the surfactant is a tridecyl alcohol surfactant.

13. The composition as recited in claim 11 wherein the silicone is in the form of a silicone oil emulsion having silicone sizes of 15 to 25 microns.

14. The composition as recited in claim 11 wherein the composition comprises volumetrically about 36–63% of the surfactant; about 7.4–21.3% of the silicone; about 7.6–24.0% of the alcohol; and about 15.0–34.0% of water.

15. A process for forming ice with water and an additive on a cooled surface having a temperature below the freezing point in a liquid mixture comprising the steps of:

(a) providing the additive of claim 5;

(b) mixing the additive with water; and (c) applying at least a portion of the liquid mixture to the cooled surface.

16. The process as recited in claim 15 wherein the step of providing is performed using an additive comprising volumetrically 36–63% of the surfactant, 7.4–21.3% of the silicone, 7.6–24.0% of the alcohol, and 15.0–34% of water.

17. The process as recited in claim 16 wherein the step of mixing is performed by mixing at least 0.16 ounces of the additive with each gallon of water treated.

18. The process as recited in claim 15 wherein the step of providing is performed using a silicone oil emulsion having a silicone size of 15 to 25 microns.

19. The process as recited in claim 15 wherein the step of mixing is performed using water having a temperature in the range of about 45° to 55° F.

20. The process as recited in claim 15 wherein the cooled surface is ice.

21. A solution composition for use in forming ice, comprising:

1 part by volume of an additive comprising about 50.0 to 77.0% by volume of an alcohol-based surfactant, about 9.9 to 27.0% by volume of a silicone oil emulsion, and about 10.0 to 30.0% by volume of ethyl alcohol; and no more than 1370 parts by volume of water.

22. The composition as recited in claim 21 wherein the silicone oil emulsion has a silicone size of 15 to 25 microns.

23. The composition as recited in claim 21 wherein the alcohol-based surfactant is a tridecyl alcohol surfactant.

24. A process using a solution performing a layer of ice on ice, such as an ice skating rink, comprising the steps of:

(a) providing the solution of claim 21; and (b) applying at least a portion of the solution to the ice.

25. The process as recited in claim 24 wherein the step of providing the solution has a temperature in the range of about 45° to 55° F.

26. The process as recited in claim 24 wherein the alcohol surfactant in the solution is a tridecyl alcohol surfactant.

27. The process as recited in claim 24 wherein the silicone oil emulsion in the solution has a silicone size of 15 to 25 microns.

28. The process as recited in claim 24 wherein the step of applying is performed by using a resurfacing unit.

* * * * *